US009000990B2

(12) United States Patent
Magid

(10) Patent No.: US 9,000,990 B2
(45) Date of Patent: Apr. 7, 2015

(54) HF ANTENNA ASSEMBLY

(75) Inventor: Yitzick Magid, Ashdod (IL)

(73) Assignee: Elbit Systems Ltd., Haifa (IL)

( * ) Notice: Subject to any disclaimer, the term of this patent is extended or adjusted under 35 U.S.C. 154(b) by 0 days.

(21) Appl. No.: 14/003,188

(22) PCT Filed: Aug. 30, 2012

(86) PCT No.: PCT/IL2012/050341

§ 371 (c)(1),
(2), (4) Date: Sep. 4, 2013

(87) PCT Pub. No.: WO2013/035093

PCT Pub. Date: Mar. 14, 2013

(65) Prior Publication Data

US 2013/0342406 A1 Dec. 26, 2013

(30) Foreign Application Priority Data

Sep. 6, 2011 (IL) ..... 215002

(51) Int. Cl.
*H01Q 1/32* (2006.01)
*H01Q 1/08* (2006.01)
*H01Q 1/14* (2006.01)
(Continued)

(52) U.S. Cl.
CPC ..... *H01Q 1/32* (2013.01); *H01Q 1/087* (2013.01); *H01Q 1/14* (2013.01); *H01Q 1/3283* (2013.01); *H01Q 9/30* (2013.01); *H01Q 11/06* (2013.01); *H01Q 21/28* (2013.01)

(58) Field of Classification Search
USPC ..... 343/715
See application file for complete search history.

(56) References Cited

U.S. PATENT DOCUMENTS 3,680,148 A 7/1972 Nolan
4,217,591 A 8/1980 Czerwinski et al.
(Continued)

FOREIGN PATENT DOCUMENTS

DE 102004013813 A1 2/2007
EP 2506365 A1 10/2012
(Continued)

OTHER PUBLICATIONS

International Search Report mailed Feb. 6, 2013 for International Application No. PCT/IL2012/050341.
(Continued)

*Primary Examiner* — Graham Smith
(74) *Attorney, Agent, or Firm* — Paul D. Bianco; Martin Fleit; Fleit Gibbons Gutman Bongini & Bianco PL

(57) ABSTRACT

Antenna assembly for providing HF radio communication in two different operating modes. The antenna assembly includes a whip antenna and at least two antenna wire segments. The whip antenna establishes short range HF radio communication with a communication target, via ground wave or low-efficiency skywave propagation, allowing communication when the antenna assembly is in motion. The antenna wire segments are deployable to form an inverted-V antenna using the whip antenna as a center mast. The inverted-V antenna establishes short or medium range HF radio communication with a communication target, via NVIS or directional skywave propagation, allowing rapid deployment of the antenna wire segments when the antenna assembly is stationary. The antenna assembly may be mounted aboard a mobile platform, such as a vehicle.

15 Claims, 4 Drawing Sheets

(51) Int. Cl.

| | |
|---|---|
| ***H01Q 9/30*** | (2006.01) |
| ***H01Q 11/06*** | (2006.01) |
| ***H01Q 21/28*** | (2006.01) |

(56) References Cited

U.S. PATENT DOCUMENTS

| | | | | |
|---|---|---|---|---|
| 4,243,989 | A * | 1/1981 | Piper | 343/715 |
| 4,433,336 | A | 2/1984 | Carr | |
| 5,218,375 | A | 6/1993 | Hillman | |
| 5,252,985 | A | 10/1993 | Christinsin | |
| 6,917,339 | B2 | 7/2005 | Li et al. | |
| 7,839,344 | B2 | 11/2010 | Marrocco et al. | |
| 2012/0249391 | A1 * | 10/2012 | Lill et al. | 343/793 |

FOREIGN PATENT DOCUMENTS

| | | | |
|---|---|---|---|
| FR | 2785094 | A1 | 4/2000 |
| FR | 2891092 | A1 | 3/2007 |
| JP | 52101949 | | 8/1977 |
| JP | S52101949 | A | 8/1977 |
| JP | 0541610 | A | 2/1993 |
| JP | 05041610 | | 2/1993 |
| JP | 2002-100928 | A | 4/2002 |

OTHER PUBLICATIONS

Written Opinion mailed Feb. 6, 2013 for International Application No. PCT/IL2012/050341.

* cited by examiner

HF ANTENNA ASSEMBLY

FIELD OF THE DISCLOSED TECHNIQUE

The disclosed technique generally relates to HF radio communication, and more particularly, to a high gain antenna assembly adapted for rapid deployment.

BACKGROUND OF THE DISCLOSED TECHNIQUE

The high frequency (HF) portion of the electromagnetic spectrum includes radio frequencies in the range of approximately 2 to 30 MHz. The HF band is suitable for transmission of ground wave radio signals for short distances (e.g., up to about 40 km), as well as skywave radio signals for longer distances. Near Vertical Incidence Skywave (NVIS) involves the propagation of radio waves, which are refracted by the ionosphere and return to the ground at a certain radius with respect to the point of origin. The NVIS propagation is implemented at acute elevation angles (e.g., 70°-90° relative to the horizontal), providing omni-directional transmission for distances up to about 300 km. Ionospheric refraction will fail to occur beyond certain frequencies, and so NVIS propagation operates best at the lower end of the HF band (e.g., approximately 2-12 MHz). These frequencies however are particularly susceptible to atmospheric noise. The ionosphere is an atmospheric layer that is ionized by solar radiation, and the refractive characteristics of the ionosphere changes based on the time of day, season of the year, location of the sun, and various additional factors which are constantly varying.

Assurance of reliable HF radio communication necessitates the employment of suitable antennas. A whip antenna is a fairly prevalent monopole antenna composed of a single straight vertical conductor element that functions as a radiating element and is mounted atop a conducting surface (ground plane). Whip antennas are commonly used aboard a vehicle or on a portable handheld transceiver, as they do not require extensive assembly or deployment operations for establishing a communication link while the vehicle or portable transceiver is in motion. Whip antennas are particularly suitable for providing ground wave radio propagation, which requires a vertically polarized antenna configuration. However, for NVIS propagation, a whip antenna provides very low gain when radiating at high elevation angles. There is a practice of utilizing a dipole antenna aboard vehicles or portable transceivers to enable NVIS communication. However, the deployment of a dipole antenna typically requires installing at least one mast for supporting the dipole wires. The installation of masts is time consuming, and increases the overall weight and cost of the antenna.

A narrow-band dipole antenna that is adapted for use at a particular frequency features relatively high gain at high elevation angles, but the dipole must be at least a certain length. For example, such a dipole antenna operating at 2 MHz has a length of approximately 74 m, which is impractical for use in many applications. Furthermore, the efficiency of the Automatic Link Establishment (ALE) systems is drastically reduced by limiting operation to a very narrow frequency band and obligating the frequent changing of the dipole length. Efficient wide-band dipole antennas generally require a large installation field (e.g., 50 m in length and 15 m in width), resulting in considerable weight due to the antenna mast and all the other necessary accessories.

U.S. Pat. No. 4,217,591 to Czerwinski et al, entitled "High frequency roll-bar loop antenna", is directed to a vehicular mounted vertical loop HF communication antenna. The antenna includes a metallic base horizontally positioned on the vehicle, and a vertically positioned metallic loop element with one end affixed to the metallic base. The antenna further includes a variable capacitor connected between the other end of the metallic loop element and the metallic base, to form a closed transmitting loop. The antenna further includes a coupling loop (e.g., of coaxial cable) coplanar with the metallic loop element and slidably mounted on the metallic base, where the area under the loop is adjustable to maintain a desired input impedance at the antenna input terminal. The antenna is adapted to provide NVIS operation over one HF frequency range, and vertically polarized whip antenna operation over another higher HF frequency range.

U.S. Pat. No. 4,433,336 to Carr, entitled "Three-element antenna formed of orthogonal loops mounted on a monopole", is directed to an antenna which is electrically steerable in a transmitting mode and which is capable of distinguishing the direction from which signals are received without a mechanical rotator. The antenna includes two loop antennas mounted on top of, and electrically coupled to, a vertically oriented monopole antenna, where the respective axes are orthogonal to one another. Each loop antenna includes an outer primary loop and a smaller inner secondary loop disposed in the same plane as the primary loop. The primary loops and secondary loops are interrupted at their top ends opposite where they join the monopole antenna. A tuning capacitor is coupled between the halves of the two primary loops, and coaxial cables feed the two secondary loops. The antenna may selectively radiate either omnidirectionally (via the monopole antenna) or directionally (via the loop antennas).

U.S. Pat. No. 5,252,985 to Christinsin, entitled "Whip tilt adapter", is directed to an adapter that enables adjusting the polarization of an HF radio whip antenna. The adapter includes a near-horizontal member pivotally attached to a vertical shaft. The near-horizontal member is held stationary with respect to the vertical shaft by securing means, such as a pin that is inserted through matching sets of holes through the member and shaft. The whip antenna is inserted into a horizontal port at the distal end of the near-horizontal member. When the member is oriented substantially horizontally, the antenna provides NVIS operation utilizing reflective/refractive characteristics of the ionosphere (e.g., at 2-14 MHz). When the near-horizontal member is oriented vertically, the antenna provides for short-distance HF groundwave communication. The member may also be oriented at various angles in between a horizontal and vertical orientation. The adapter may be installed on a mounting base on a vehicle.

U.S. Pat. No. 6,917,339 to Li et al, entitled "Multi-band broadband planar antennas", is directed to planar antenna with multi-band and broadband functionalities applicable for compact antenna applications (e.g., at around 2-5 GHz). The antenna includes two inverted-L antennas (ILAs) facing each other across a gap. One of the ILAs is input fed (e.g., directly by a coaxial cable input), and the other ILA is electromagnetically coupled to the fed ILA. The vertical legs of the two ILAs are parallel and substantially the same length, while the horizontal leg of the fed ILA is shorter than the horizontal leg of the coupled ILA. The position of the gap affects the bandwidth of the antenna. In one embodiment, a dual-band antenna includes a monopole antenna disposed between the ILAs. The monopole receives input fed and is connected to the input fed ILA near its base. The monopole is designed for resonance at a higher frequency than the ILAs.

U.S. Pat. No. 7,839,344 to Marrocco et al, entitled "Wideband multifunction antenna operating in the HF range, particularly for naval installations", is directed to a wideband linear HF antenna designed particularly for fixed installations onboard naval units for military communications. The antenna includes a plurality of radiating elements forming conducting branches arranged in a bifolded configuration (i.e., two closed nested coplanar paths). The antenna further includes electrical impedance elements disposed within the conducting branches, to selectively impede current flow within selected frequency ranges to establish current paths according to the operating frequency. The antenna is adapted to provide uniform radiation at different angles of elevation for the entire HF band. In particular: NVIS communication at the lower HF range (2-4 MHz) and shorter distances (up to 150 km); sea wave and ionospheric reflection communication at low HF frequencies (2-7 MHz) and slightly greater distances (up to 500 km); ionospheric reflection communication at medium HF frequencies (6-15 MHz) and medium distances (1000-2000 km); and communication at low-medium angles of elevation (5-30° at higher HF frequencies (15-20 MHz).

Additional dual antenna arrangements which combine monopoles and dipoles can be found in Japanese Patent Publication No. 5041610(A) to Taniyoshi, entitled: "Antenna for mobile body"; Japanese Patent Publication No. 52101949(A) to Kawai et al, entitled: "Antenna apparatus"; and Japanese Patent Publication No. 2002-100928(A) to Inoue, entitled: "Composite antenna".

SUMMARY OF THE DISCLOSED TECHNIQUE

In accordance with one aspect of the disclosed technique, there is thus provided an antenna assembly for providing high frequency (HF) radio communication in two different operating modes. The antenna assembly includes a whip antenna and at least two antenna wire segments. The whip antenna establishes short range HF radio communication with a communication target, via ground wave or low-efficiency skywave propagation, allowing communication when the antenna assembly is in motion. The antenna wire segments are deployable to form an inverted-V antenna using the whip antenna as a center mast. The inverted-V antenna establishes short or medium range HF radio communication with a communication target, via Near Vertical Incidence Skywave (NVIS) or directional skywave propagation, allowing rapid deployment of the antenna wire segments when the antenna assembly is stationary. The antenna assembly may be mounted aboard a mobile platform, such as a vehicle. The antenna assembly may alternatively be conveyed by at least one person, or further alternatively be mounted aboard a stationary platform. The short range communication may be with a communication target situated at a range of up to approximately 300 km from the antenna assembly. The medium range communication may be with a communication target situated at a range of between approximately 300-1000 km from the antenna assembly. The antenna assembly may further include an antenna isolator, coupled with the whip antenna and the antenna wire segments. The antenna isolator provides isolation between the whip antenna and the antenna wire segments, preventing current leakage during high voltage operation. The antenna assembly may further include an HF transceiver, coupled with the whip antenna and the antenna wire segments, for transmitting and receiving HF radio frequency signals. The HF transceiver may be coupled with the antenna wire segments via a twin-lead cable. The antenna assembly may further include an antenna coupler, coupled with the whip antenna, with the antenna wire segments, and with the HF transceiver. The antenna coupler tunes the operational antenna impedance to match the transmitter/receiver output/input impedance of the HF transceiver. The antenna coupler may be a balanced antenna coupler. The antenna assembly may further include at least two ground anchors and at least two wire isolators. The ground anchors are secured to a ground surface when forming the inverted-V antenna. The wire isolators are coupled to respective ground anchors and to respective antenna wire segments, providing isolation of the antenna wire segments from the ground surface. The whip antenna is bent downwards when establishing the short range communication, to enable safe motion of the antenna assembly. The whip antenna is aligned in an upright position when used as a central mast for the inverted-V antenna. The whip antenna includes a whip antenna radiator and a whip antenna base, which can support the whip antenna radiator in a bent position or in an upright position. The antenna assembly may further include at least two wire holders, coupled with the antenna isolator, for holding the antenna wire segments when the inverted-V antenna is formed. A storage bag may be used to store away the antenna wire segments when not in use. The antenna wire segments may be wound onto a spool when not in use, and unwound from the spool when being deployed to form the inverted-V antenna. A winding mechanism may be used to wind and unwind the antenna wire segments onto or from the spool.

In accordance with another aspect of the disclosed technique, there is thus provided a method for establishing and maintaining HF radio communication in two different operating modes with an antenna assembly. The method includes the procedure of initiating an HF radio communication session with the antenna assembly. The method further includes the procedure of, when the antenna assembly is in motion, selecting a whip antenna operating mode of the antenna assembly, and activating the whip antenna to provide short range HF radio communication with a communication target, via ground wave or low-efficiency skywave propagation, allowing communication when the antenna assembly is in motion. The method further includes the procedure of, when the antenna assembly is stationary, selecting an inverted-V antenna operating mode of the antenna assembly, deploying antenna wire segments of the antenna assembly and forming an inverted-V antenna using the whip antenna as a center mast, and activating the inverted-V antenna to provide short or medium range HF radio communication with a communication target, via Near Vertical Incidence Skywave (NVIS) or directional skywave propagation, allowing rapid deployment of the antenna wire segments when the antenna assembly is stationary. The method further includes the procedure of terminating the HF radio communication session. The antenna assembly may be mounted aboard a mobile platform, such as a vehicle. The antenna assembly may alternatively be conveyed by at least one person, or further alternatively be mounted aboard a stationary platform. The short range communication may be with a communication target situated at a range of up to approximately 300 km from the antenna assembly. The medium range communication may be with a communication target situated at a range of between approximately 300-1000 km from the antenna assembly. Deploying the antenna wire segments may include securing ground anchors to a ground surface, coupling a wire isolator to each of the ground anchors, and coupling an end of each of the antenna wire segments to a respective one of the wire isolators, which provide isolation of the antenna wire segments from the ground surface. The method may further include the procedure of bending the whip antenna downwards before activating the whip antenna, to enable safe motion of the antenna assembly. The whip antenna is aligned in an upright position when used as a central mast for the inverted-V antenna. A storage bag may be used to store away the antenna wire segments when not in use. The antenna wire segments may be wound onto a spool when not in use, and unwound from the spool when being deployed to form the inverted-V antenna.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by providing an antenna assembly adapted for rapid deployment and to provide effective and reliable HF radio communication aboard a mobile platform, using either a whip antenna operating mode to provide ground wave or low efficiency skywave propagation for short range communication, or an inverted-V antenna operating mode to provide skywave propagation for short range or medium range communication.

The term "mobile platform", and any variations thereof, as used herein refers to any platform or surface capable of moving from one location to another, including, but not limited to: a vehicle, a transportation medium, or a person. Accordingly, the antenna assembly of the disclosed technique may be mounted onto a vehicle (i.e., constituting a vehicle-mounted antenna assembly) or conveyed directly by at least one person (i.e., constituting a portable antenna assembly).

Figure 1:
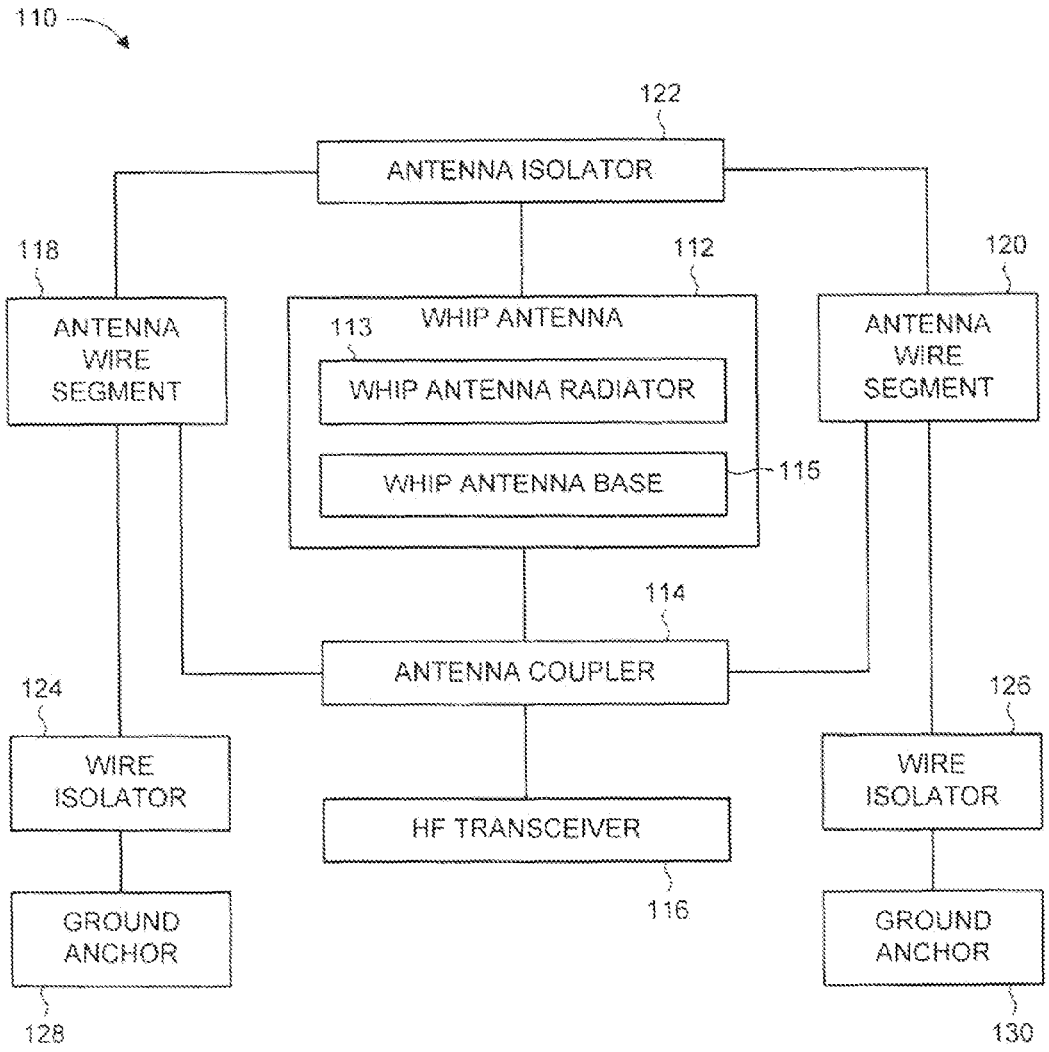
FIG. 1 is a block diagram of an antenna assembly for HF radio communication in two different operating modes, constructed and operative in accordance with an embodiment of the disclosed technique.
Figure 2:
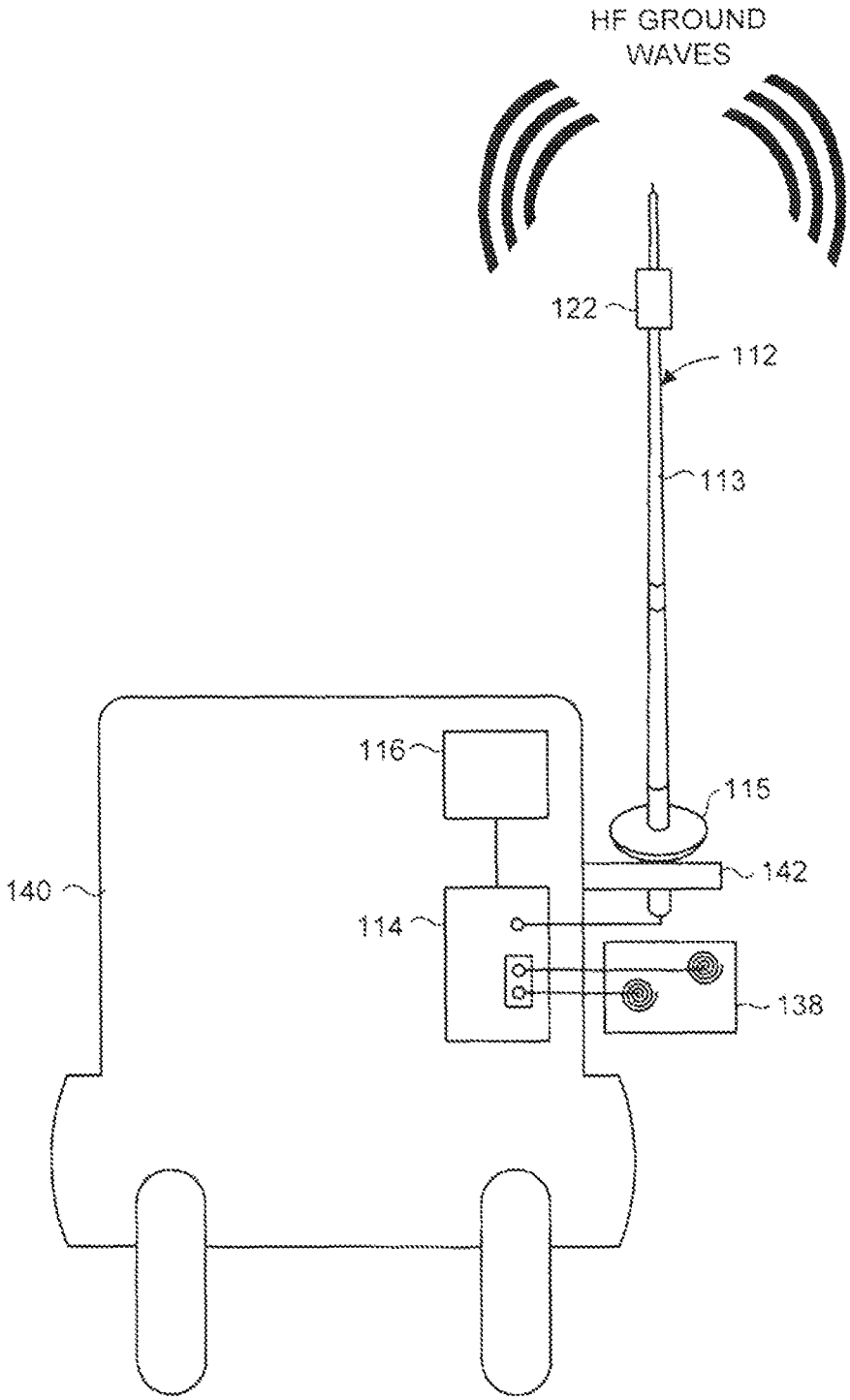
FIG. 2 is a rear view schematic illustration of the antenna assembly of FIG. 1 mounted on an armored military vehicle and deployed in a whip antenna operating mode, constructed and operative in accordance with an embodiment of the disclosed technique.
Figure 3:
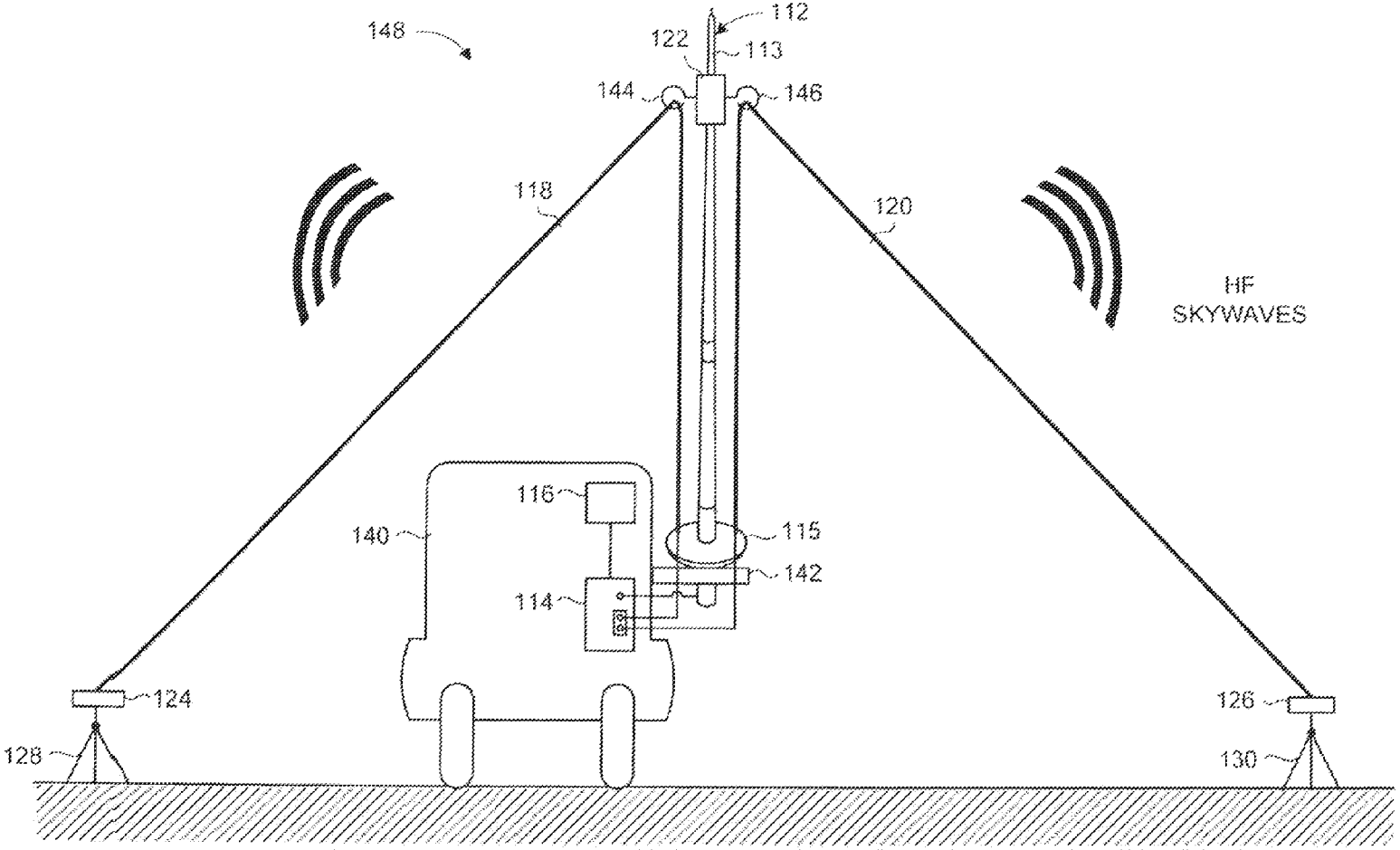
FIG. 3 is a rear view schematic illustration of the antenna assembly of FIG. 1 mounted on an armored military vehicle and deployed in an inverted-V antenna operating mode, constructed and operative in accordance with an embodiment of the disclosed technique.

Reference is now made to FIGS. 1, 2 and 3. FIG. 1 is a block diagram of an antenna assembly, generally referenced 110, constructed and operative in accordance with an embodiment of the disclosed technique. FIG. 2 is a rear view schematic illustration of the antenna assembly 110 of FIG. 1 mounted on an armored military vehicle, generally referenced 140, and deployed in a whip antenna operating mode, constructed and operative in accordance with an embodiment of the disclosed technique. FIG. 3 is a rear view schematic illustration of the antenna assembly 110 of FIG. 1 mounted on an armored military vehicle 140 and deployed in an inverted-V antenna operating mode, constructed and operative in accordance with an embodiment of the disclosed technique. Antenna assembly 110 includes a whip antenna 112, a balanced antenna coupler 114, an HF transceiver 116, a pair of antenna wire segments 118 and 120, an antenna isolator 122, a pair of wire isolators 124 and 126, and a pair of ground anchors 128 and 130. Whip antenna 112 is made up of a radiator portion 113 and a base portion 115.

Antenna isolator 122 is coupled with whip antenna 112 and with antenna wire segments 118 and 120. Antenna coupler 114 is coupled with whip antenna 112, with antenna wire segments 118 and 120, and with HF transceiver 116. Antenna wire segments 118, 120 are each coupled with a respective wire isolator 124, 126, which in turn are each coupled with a respective ground anchor 128, 130, when deployed to provide an inverted-V antenna, as will be elaborated upon herein below.

Antenna assembly 110 is preferably mounted onto a vehicle, such as a civilian-operated vehicle (e.g., a truck, a sport utility vehicle (SUV), an off-road vehicle, a transporter vehicle, a Jeep, a Land Rover model vehicle, a Hummer brand vehicle, and the like) or a military vehicle (e.g., a tank, an armored personnel carrier such as the BTR series, and the like), a ship (e.g., a naval ship), or onto another type of mobile platform. Antenna assembly 110 may alternatively be held by a user (e.g., carried by a soldier) or mounted onto a fixed stationary platform. When mounted on a vehicle or other mobile platform, antenna assembly 110 utilizes a larger and more powerful antenna coupler (e.g., 150 W) and a heavier and more rugged whip antenna, to ensure robustness and integrity. When used in a portable configuration (i.e., being carried by a person), antenna assembly 110 utilizes a lighter weight antenna coupler (e.g., 30 W) and a lighter weight whip antenna (e.g., 1 kg), to ease carrying and transportation.

Whip antenna 112 is a standard monopole antenna with an omnidirectional radiation pattern, made up of a straight flexible wire mounted perpendicularly over a conducting surface, as known in the art. Whip antenna 112 may be telescopically extendable and retractable, or may be composed of individual sections that are attachable and detachable to/from one other in order to extend or retract the antenna as necessary for operation. Whip antenna 112 is fixedly mounted onto a short ledge 142 adjoining a side of vehicle 140. Alternatively, whip antenna 112 may be mounted onto another region of vehicle 140 (e.g., on the roof of vehicle 140) or onto a component affixed to a different region of vehicle (e.g., near the front or rear thereof). Whip antenna base 115, or an alternative/additional structural feature of whip antenna 112, enables selective bending of the whip antenna radiator 113 in a particular direction (e.g., forward, backward, toward one side) or maintaining whip antenna radiator 113 in an upright position.

Antenna wire segments 118 and 120 are long portions of wires of metallic conductors that can mutually function as a driven element in a dipole antenna configuration. Each wire segment 118, 120, is wound onto a spool or reel allowing the wire segment to be lengthened or shortened. The other end of wire segments 118, 120 is connected to antenna coupler 114. When not in use, antenna wire segments 118, 120 are preferably kept fully wound around the spool and stored inside a storage bag 138 (FIG. 2). When deployed, each wire segment 118, 120 is removed from storage bag 138 and routed through a respective wire holder 144, 146 affixed to either side of antenna isolator 122. Wire holders 144 and 146 may each be formed as a small ring with an opening and extending horizontally from the vertically oriented whip antenna radiator 113 (as depicted in FIG. 3), such that each wire segment 118, 120 is looped through the respective ring with one end hanging downward on either side. Wire holders 144, 146 may be embodied by an alternative structure or configuration in a manner which enables the deployment of wire segments 118, 120 in an inverted-V formation using whip antenna 112 as a central mast while maintaining isolation between wire segments 118, 120 and whip antenna 112. Antenna assembly 110 may generally include any even number of antenna wire segments, but preferably includes two (a larger number of wire segments may slightly increase the overall antenna gain, but would significantly lengthen the time required for deployment). The wire segments 118, 120 are manufactured from antenna wire that provides the required strength when tensioned and yet flexible enough for rapid deployment during multiple instances (i.e., the antenna wire segments may be reused numerous times and stored/retrieved as needed). Antenna assembly 110 may include a mechanism for winding and unwinding antenna wire segments 118, 120 around their spools in a quick and convenient manner (e.g., similar to a self-extracting tape measure device). In general, antenna wire segments 118, 120 may be wound or unwound using any suitable device or mechanism for retracting or extending the length of wire segments 118, 120. For example, antenna wire segments 118, 120 may be composed of a retractable/extendable telescopic cable, or a single cable that is dividable into multiple shorter sections (each of which may be stored away separately).

Antenna coupler 114 provides equal current at both terminals of antenna wire segments 118, 120 and eliminates any additional RF current on the coaxial shielding. Antenna coupler 114 efficiently and automatically tunes the operational antenna impedance to match the transmitter/receiver output/input impedance of HF transceiver 116 (which is typically around 50 Ω). Antenna coupler 114 is preferably a balanced antenna coupler, which establishes a true isolation of the antenna terminals from the ground and provides equal current levels at both terminals, which significantly improves the antenna gain and radiation pattern. An unbalanced coupler, which would result in a much lower overall antenna gain, may optionally be used instead.

HF transceiver 116 includes all the necessary components and circuitry for transmitting and receiving RF signals within the high frequency (HF) portion of the radio spectrum (i.e., approximately 2-30 MHz). HF transceiver 116 incorporates the transmitting and receiving components in a single unit, although may alternatively be embodied by separate transmitter and receiver units. HF transceiver 116 is coupled to antenna coupler 114 through a feed line, such as a coaxial cable, that provides an RF signal for transmitting/receiving and a DC voltage for the operation of antenna coupler 114. Alternatively, HF transceiver 116 may be coupled to antenna coupler 114 with both a coaxial cable and an additional control/DC voltage cable. HF transceiver 116 also incorporates a radio panel interface that allows a user to select different operational modes and settings for antenna assembly 110.

Antenna isolator 122 is preferably affixed to the upper portion of whip antenna radiator 113 (e.g., at the very tip) and provides the required isolation between the whip antenna 112 and the wire segments 118 and 120, preventing current leakage during high voltage operation. Antenna isolator 122 may generally be disposed at any location along whip antenna radiator 113. It should be noted that raising the height of antenna isolator 122 along whip antenna radiator 113 will increase the dipole gain of the inverted-V antenna formed by wire segments 118, 120 but necessitates a more rigid whip antenna 112, while conversely, a lower situated antenna isolator 122 enables a more flexible whip antenna 112 to be used but results in a lower dipole gain.

Referring now to FIG. 2, whip antenna 112 is utilized to establish an HF radio communication link with a communication target (not shown) while vehicle 140 is in motion. An operator of vehicle 140 (e.g., a driver or a passenger) initially selects a whip antenna operating mode of antenna assembly 110, such that all the output power from HF transceiver 116 will be directed through only to the whip antenna terminal (and not to the wire segments terminals). While whip antenna 112 is operational, antenna wire segments 118 and 120 are preferably stored in the storage bag 138 and deactivated, for practical considerations and so as not to diminish the gain of whip antenna 112. Whip antenna radiator 113 is bent downwards to permit vehicle 140 to continue travelling in a safe manner, preventing any impacts, shocks or collisions that could occur if whip antenna radiator 113 was in an upright position. The bending of whip antenna radiator 113 may be implemented remotely while vehicle 140 is in motion, e.g., using a remote control associated with whip antenna 112. Whip antenna 112 functions as a radiating element that provides HF ground wave propagation, so that ground wave radio signals are transmitted to and received from the target located a relatively short distance away (e.g., up to approximately 40 km from antenna assembly 110). Whip antenna 112 may also be utilized to provide HF skywave propagation although at a reduced efficiency (the antenna gain at acute elevation angles is very low, especially at lower HF frequencies), allowing skywave radio signals to reach a target situated at a range of approximately 40-200 km. When the communication session is completed, whip antenna 112 is deactivated and ceases propagation of ground wave/low-efficiency skywave radio frequencies.

Referring now to FIG. 3, when the operator of vehicle 140 wants to establish a communication link with a communication target (not shown) located at a further distance away (e.g., at a range of approximately 40-300 km from antenna assembly 110), ground wave HF propagation is insufficient. Accordingly, the operator stops (e.g., parks) vehicle 140 at a suitable location and then proceeds to deploy antenna wire segments 118, 120 to form an inverted-V antenna structure. In particular, the operator retrieves the wound spools of antenna wire segments 118, 120 from within storage bag 138 and unwinds the antenna wire segments 118, 120 from their respective spools. At a specific marked point of each wire segment, the operator secures the anchors 128, 130 into the ground. Ground anchors 128, 130 are positioned on either side of vehicle 140 at a minimum distance (e.g., 8-25 m) away from vehicle 140. Ground anchors 128, 130 are coupled to respective wire isolators 124, 126, e.g., via polyethylene terephthalate (PET) fibers, and the wire isolators 124, 126 are coupled to the free end of respective antenna wire segments 118, 120, which are pulled taught. Ground anchors 128, 130 may be embodied by any suitable device or mechanism adapted to securely fasten an antenna wire segment to the ground surface, while ensuring isolation between the wire segments 118, 120 and the ground. For example, wire segments 118, 120 may be affixed to another structure situated on the ground (e.g., a fencepost) as long as the wire isolation is maintained. Consequently, each wire segment 118, 120 extends vertically along the vertically oriented whip antenna 112 until a distal end of whip antenna 112 at which it is coupled (i.e., at wire holders 144, 146 affixed to either side of antenna isolator 122) and then slopes downward toward anchors 128, 130 secured to the ground, together forming an inverted-V configuration. Antenna wire segments 118, 120 function as radiating elements while whip antenna 112 functions as a central supporting mast for an inverted-V antenna, generally referenced 148. Antenna wire segments 118, 120 may generally be coupled to whip antenna 112 at any point thereof (e.g., wire holders 144, 146 may be disposed at any height respective of whip antenna 112), but the gain of inverted-V antenna 148 is a function of the height of the wire segments 118, 120, such that the antenna gain increases as the apexes of wire segments 118, 120 are raised higher.

Inverted-V antenna 148 is preferably configured in a symmetrical manner, i.e., such that the height of both wire segments 118, 120 are substantially similar and the angles formed between the mast and each of the wire segments 118, 120 are substantially similar. A non-symmetrical configuration would result in reduced efficiency. The antenna wire segments 118, 120 are preferably completely unspooled (i.e., to attain their maximum length) in order to obtain the highest antenna gain. For example, wire segments 118, 120 having a length of around 15 m would provide efficient NVIS communication in different environments (e.g., during both daytime and nighttime). Theoretically, optimal efficiency and antenna gain would result if the antenna wire segments were to be deployed in a perfectly horizontal alignment, but practically this is not feasible and would require a considerable amount of time and resources to set up. Antenna wire segments 118, 120 may be coupled to HF transceiver 116 indirectly, via an intermediate coupler, such that wire segments 118, 120 do not extend all the way to HF transceiver 116 when inverted-V antenna 148 is deployed. For example, a twin-lead cable may be used to convey RF signals between HF transceiver 116 and antenna wire segments 118, 120, such that the twin-lead cable is coupled at one end to HF transceiver 116 and at the other end to a splitter coupled to each of antenna wire segments 118, 120. It is appreciated that the deployment of inverted-V antenna 148 may be done fairly quickly, typically requiring only a few minutes to set up completely.

The operator proceeds to select an inverted-V antenna operating mode of antenna assembly 110 (e.g., via the radio panel interface of HF transceiver 116), such that all the output power from HF transceiver 116 will be directed through only to the wire segments terminals (and not to the whip antenna terminal). While inverted-V antenna 148 is operational, whip antenna 112 is deactivated (i.e., does not radiate) and is prevented from interference with wire segments 118, 120 by antenna isolator 122. Inverted-V antenna 148 provides HF skywave propagation, allowing HF radio communication with a relatively distant communication target. In particular, inverted-V antenna 148 may operate through NVIS propagation, utilizing reflections and refractions from the ionosphere, allowing NVIS radio signals to reach a "short range" target situated at a range of up to approximately 300 km (omni-directionally). Inverted-V antenna 148 may also operate through directional skywave propagation, allowing skywave radio signals to reach a "medium range" target situated at a range of approximately 300-1000 km. When the communication session is completed, wire segments 118 and 120 are deactivated and the operator dismantles inverted-V antenna 148, i.e., by detaching antenna wire segments 118, 120 from the respective wire isolators 124, 126 and from the respective anchors 128, 130. Antenna wire segments 118, 120 are then wound back onto their spools and placed back into storage bag 138. Wire isolators 124, 126 and ground anchors 128, 130 may also be stored away while not in use.

It is appreciated that whip antenna operation of antenna assembly 110 allows an operator of vehicle 140 to quickly and conveniently establish secure and effective HF radio communication (i.e., ground wave or low-efficiency skywave propagation) with a relatively near (short range) communication target while vehicle 140 is in motion. Correspondingly, inverted-V antenna operation of antenna assembly 110 allows the vehicle operator to establish secure and effective HF radio communication (i.e., NVIS or directional skywave propagation) with a relatively near (short range) or relatively distant (medium range) communication target, briefly after stopping vehicle 140 (e.g., after several minutes required for setup). In this manner, a single antenna assembly in accordance with the disclosed technique can be utilized in different ways, depending on the circumstances, for providing reliable HF radio communication.

It is noted that if the vehicle operator inadvertently attempts to activate the wrong antenna after a particular antenna operational mode for antenna assembly 110 has been selected, the operator may be notified accordingly (e.g., via a warning message displayed on the radio panel interface of HF transceiver 116).

Figure 4:
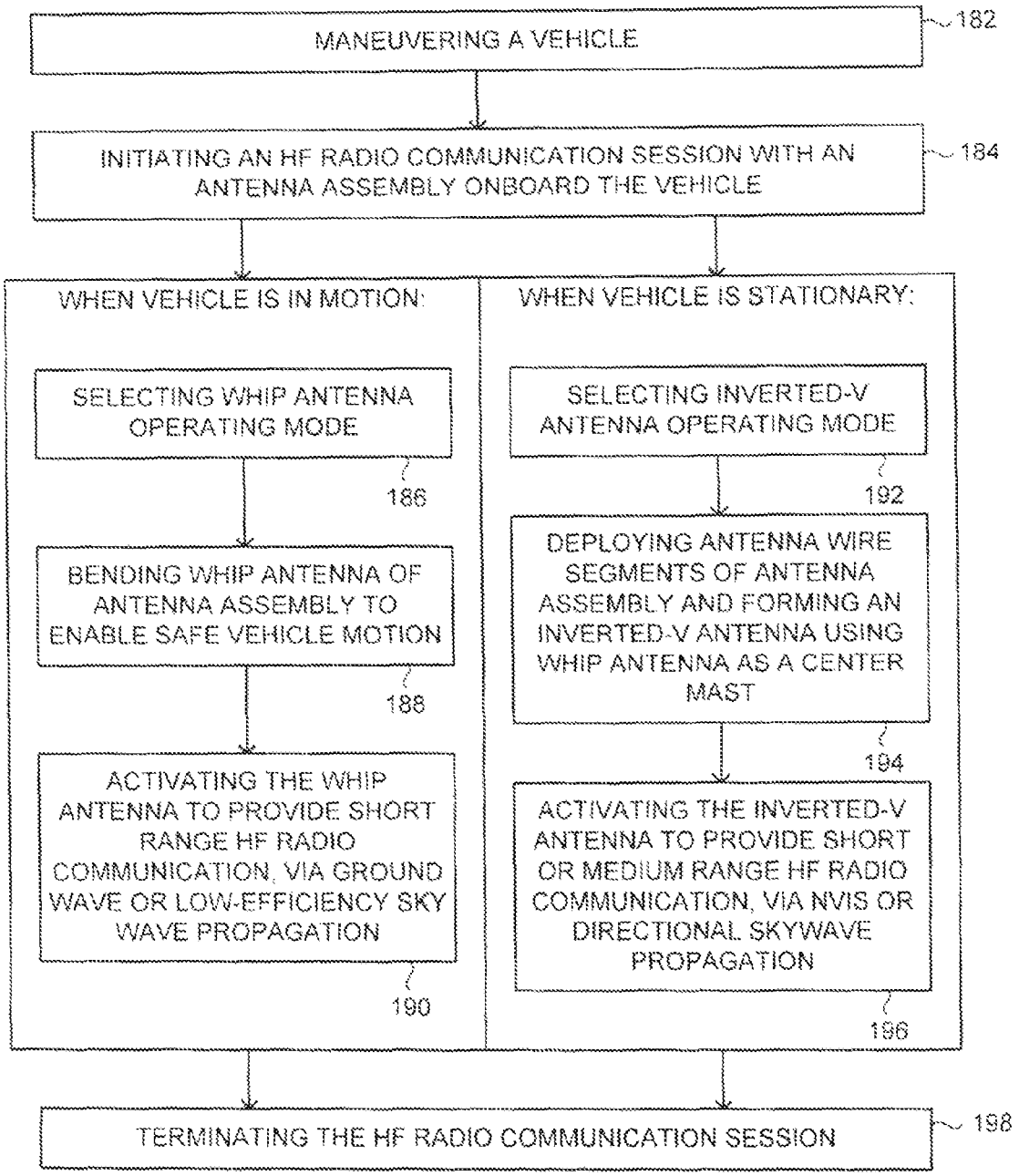
FIG. 4 is a block diagram of a method for establishing and maintaining HF radio communication in two different operating modes with an antenna assembly, operative in accordance with an embodiment of the disclosed technique.

Reference is now made to FIG. 4, which is a block diagram of a method for establishing and maintaining HF radio communication in two different operating modes with an antenna assembly, operative in accordance with an embodiment of the disclosed technique. In procedure 182, a vehicle is maneuvered. Referring to FIGS. 2 and 3, armored military vehicle 140 is driven by a vehicle driver.

In procedure 184, an HF radio communication session is initiated with an antenna assembly onboard the vehicle. Referring to FIGS. 2 and 3, a vehicle operator of vehicle 140 uses antenna assembly 110 to initiate a radio communication session with a communication target (not shown).

When the vehicle is in motion, short range radio communication may be established. In procedure 186, a whip antenna operating mode is selected. Referring to FIG. 2, a vehicle operator of vehicle 140 selects a whip antenna operating mode of antenna assembly 110, e.g., via a radio panel interface of HF transceiver 116. In procedure 188, the whip antenna of the antenna assembly is bent to enable safe vehicle motion. Referring to FIG. 2, an operator of vehicle 140 bends whip antenna radiator 113 downwards, to permit vehicle 140 to continue travelling in a safe manner and avoiding impacts, shocks or collisions that could occur if whip antenna radiator 113 was positioned upright. In procedure 190, the whip antenna is activated to provide short range HF radio communication, via ground wave or low-efficiency skywave propagation. Referring to FIG. 2, whip antenna 112 may provide HF ground wave propagation to allow communication with a target situated up to approximately 40 km away. Alternatively, whip antenna 112 may be utilized to provide HF skywave propagation at a reduced efficiency to allow communication with a target situated at a range of approximately 40-200 km away.

When the vehicle is stationary (i.e., after the vehicle driver has stopped or parked the vehicle), short range or medium range HF radio communication may be established. In procedure 192, an inverted-V antenna operating mode is selected. Referring to FIG. 3, a vehicle operator of vehicle 140 selects an inverted-V antenna operating mode of antenna assembly 110, e.g., via a radio panel interface of HF transceiver 116. In procedure 194, antenna wire segments of the antenna assembly are deployed and an inverted-V antenna is formed using the whip antenna as a center mast. Referring to FIG. 3, an operator of vehicle 140 sets up inverted-V antenna 148 using antenna wire segments 118, 120 as radiating elements and whip antenna 112 as a central supporting mast. Wire segments 118, 120 are retrieved from storage bag 138 and unwound from their spools; ground anchors 1128, 130 are secured to the ground at fixed distances on either side of vehicle 140; antenna wire segments 118, 120 are pulled taught while positioned through wire holders 144, 146 affixed to antenna isolator 122, and then angled downwards and joined to wire isolators 124, 160, which are affixed to ground anchors 128, 130 (e.g., via PET fibers). In procedure 196, the inverted-V antenna is activated to provide short or medium range HF radio communication, via NVIS or directional skywave propagation. Referring to FIG. 3, inverted-V antenna 148 may provide omni-directional NVIS propagation to allow communication with a short range target situated up to approximately 300 km away. Inverted-V antenna 148 may also provide directional skywave propagation to allow communication with a medium range target situated at a range of approximately 300-1000 km away.

In procedure 198, the HF radio communication session is terminated. Referring to FIGS. 2 and 3, the operator of vehicle 140 terminates the radio communication session with the communication target. If antenna assembly 110 had been operating in whip antenna operating mode, then the operator deactivates whip antenna 112 which then ceases ground wave/low-efficiency skywave propagation. If antenna assembly 110 had been operating in inverted-V antenna operating mode, then the operator deactivates antenna wire segments 118, 120 to cease NVIS/directional skywave propagation and dismantles inverted-V antenna 148.

It will be appreciated by persons skilled in the art that the disclosed technique is not limited to what has been particularly shown and described hereinabove.

This invention claimed is:

1. An antenna assembly for providing high frequency (HF) radio communication in two different operating modes, said antenna assembly comprising:

a whip antenna;

at least two antenna wire segments; and an HF transceiver, coupled to said whip antenna and further coupled to each of said antenna wire segments, said HF transceiver configured to receive a selection of an operating mode of said antenna assembly, and configured to selectively transmit and receive HF radio frequency signals through said whip antenna or through said antenna wire segments, wherein in a first operating mode of said antenna assembly, said antenna wire segments are configured to be non-radiating, while said whip antenna is configured as a radiating element for establishing short range HF radio communication with a communication target, via ground wave or low efficiency skywave propagation, allowing communication when said antenna assembly is in motion; and wherein in a second operating mode of said antenna assembly, said antenna wire segments are configured to be deployed as radiating elements to form an inverted-V antenna with said whip antenna configured as a non-radiating center mast, said inverted-V antenna operative to establish short or medium range HF radio communication with a communication target, via Near Vertical Incidence Skywave (NVIS) or directional skywave propagation, allowing communication when said antenna assembly is stationary.

2. The antenna assembly of claim 1, wherein said antenna assembly is mounted aboard a vehicle.

3. The antenna assembly of claim 1, wherein said antenna assembly is conveyed by at least one person.

4. The antenna assembly of claim 1, wherein said antenna assembly is mounted aboard a stationary platform.

5. The antenna assembly of claim 1, further comprising:

an antenna isolator, coupled with said whip antenna and said antenna wire segments, said antenna isolator operative to provide isolation between said whip antenna and said antenna wire segments.

6. The antenna assembly of claim 1, further comprising: an antenna coupler, coupled with said whip antenna, with said antenna wire segments, and with said HF transceiver, said antenna coupler operative to tune the operational antenna impedance to match the transmitter/receiver output/input impedance of said HF transceiver.

7. The antenna assembly of claim 1, further comprising:

at least two ground anchors, operative for being secured to a ground surface when forming said inverted-V antenna; and at least two wire isolators, each coupled to a respective one of said ground anchors and to a respective one of said antenna wire segments, said wire isolators providing isolation of said antenna wire segments from said ground surface.

8. The antenna assembly of claim 1, wherein said whip antenna is bent downwards when establishing said short range communication, to enable safe motion of said antenna assembly.

9. The antenna assembly of claim 1, wherein said whip antenna is aligned in an upright position when used as a central mast for said inverted-V antenna.

10. The antenna assembly of claim 5, further comprising at least two wire holders, coupled with said antenna isolator, said wire holders operative for holding said antenna wire segments when said inverted V antenna is formed.

11. The antenna assembly of claim 1, wherein said antenna wire segments are wound onto a spool when not in use, and unwound from said spool when being deployed to form said inverted-V antenna.

12. A method for establishing and maintaining HF radio communication in two different operating modes with an antenna assembly comprising a whip antenna, at least two antenna wire segments, and an HF transceiver coupled to said whip antenna and further coupled to each of said antenna wire segments, the method comprising the procedures of:

initiating an HF radio communication session with said antenna assembly;

selecting a first operating mode of said antenna assembly via said HF transceiver; and activating said whip antenna as a radiating element, while said antenna wire segments are non radiating, to provide short range HF radio communication with a communication target, via ground wave or low efficiency skywave propagation, allowing communication when said antenna assembly is in motion, selecting a second operating mode of said antenna assembly via said HF transceiver;

deploying said antenna wire segments as radiating elements to form an inverted-V antenna with said whip antenna configured as a non-radiating center mast;

activating said inverted-V antenna in said second operating mode to provide short or medium range HF radio communication with a communication target, via Near Vertical Incidence Skywave (NVIS) or directional skywave propagation, allowing communication when said antenna assembly is stationary; and terminating said HF radio communication session.

13. The method of claim 12, wherein said antenna assembly is mounted aboard a vehicle.

14. The method of claim 12, wherein said procedure of deploying antenna wire segments comprises securing ground anchors to a ground surface, coupling a wire isolator to each of said ground anchors, and coupling an end of each of said antenna wire segments to a respective one of said wire isolators, said wire isolators providing isolation of said antenna wire segments from said ground surface.

15. The method of claim 12, further comprising the procedure of bending said whip antenna downwards before activating said whip antenna, to enable safe motion of said antenna assembly.

* * * * *